US007661734B2

(12) United States Patent
Lignell

(10) Patent No.: US 7,661,734 B2
(45) Date of Patent: Feb. 16, 2010

(54) DOOR KNOB COVER

(76) Inventor: Kirk Lignell, 4497 Lake Forest Dr. East, Ann Arbor, MI (US) 48108

( * ) Notice: Subject to any disclaimer, the term of this patent is extended or adjusted under 35 U.S.C. 154(b) by 0 days.

(21) Appl. No.: 11/372,606

(22) Filed: Mar. 10, 2006

(65) Prior Publication Data

US 2006/0202484 A1 Sep. 14, 2006

Related U.S. Application Data

(60) Provisional application No. 60/660,827, filed on Mar. 11, 2005.

(51) Int. Cl.
*E05B 3/00* (2006.01)
*E05C 19/18* (2006.01)

(52) U.S. Cl. ..... 292/348; 292/288; 292/289; 292/DIG. 2

(58) Field of Classification Search ..... 292/288, 292/289, 348, DIG. 2
See application file for complete search history.

(56) References Cited

U.S. PATENT DOCUMENTS 329,321 A * 10/1885 Leger ..... 292/347
2,610,877 A * 9/1952 Weaver ..... 292/1
2,721,597 A * 10/1955 Frank ..... 16/86 A
2,997,089 A * 8/1961 Amdur et al. ..... 16/402
3,306,643 A * 2/1967 Reed ..... 292/1
3,428,351 A * 2/1969 Valk ..... 292/347
3,556,571 A * 1/1971 Laub ..... 292/1
4,082,351 A * 4/1978 Chrones ..... 292/347
4,570,470 A * 2/1986 Gray, Sr. ..... 70/428
4,899,564 A * 2/1990 Gilbert ..... 70/428
5,423,583 A * 6/1995 Crockom ..... 292/289
5,425,256 A * 6/1995 Crosby ..... 70/209
5,501,494 A * 3/1996 Willetts ..... 292/262
5,615,567 A * 4/1997 Kemp ..... 70/455
5,713,615 A * 2/1998 Tsai ..... 292/347
5,794,871 A * 8/1998 Willetts ..... 292/288
6,658,906 B1 * 12/2003 Wright ..... 70/455

* cited by examiner

*Primary Examiner*—Carlos Lugo
(74) *Attorney, Agent, or Firm*—Brinks Hofer Gilson & Lione

(57) ABSTRACT

An apparatus to prevent actuation of a locking mechanism integrated in a door knob is provided. The apparatus includes a door knob cover and a cap portion. The door knob cover is configured to engage the door knob during actuation of the door knob. The cap portion is supported by the door knob cover and configured to prevent the locking mechanism from actuating.

12 Claims, 5 Drawing Sheets

DOOR KNOB COVER

RELATED APPLICATION

This application claims the benefit of U.S. provisional application entitled DOOR KNOB COVER, application No. 60/660,827 filed on Mar. 11, 2005, the entirety of which is hereby incorporated by reference.

BACKGROUND

1. Field of the Invention

The present invention generally relates to a door knob cover configured to prevent actuation of a lock.

2. Description of Related Art

Often door knobs for interior residential applications include an integrated locking mechanism. The door knob unit with an integrated locking mechanism generally has a round button on an inner door knob that may be pushed in or turned to activate the locking mechanism. Additionally, the door knob unit may have an external door knob requiring a key or tool to unlock the locking mechanism or alternatively there may be no external door knob.

Door knob units with integrated locking mechanisms are typically installed on doors of rooms which may require privacy including bathrooms, bedrooms, offices, or external doors. In most situations, it may be advantageous to have an integrated locking mechanism. However, inadvertent activation of the integrated lock mechanism may be disadvantageous. In situations where quick access is required, doors may be inadvertently locked, rendering the room inaccessible. One example may include a household with a toddler where the young child may inadvertently engage the locking mechanism by pushing or turning the button on the door knob thereby becoming locked in a room and inaccessible. In a bathroom where chemicals are stored, this may be particularly dangerous.

In view of the above, it is apparent that there exists a need to prevent doors from being locked inadvertently.

SUMMARY OF THE INVENTION

In satisfying the above needs, as well as overcoming the enumerated drawbacks and other limitations of the related art, an embodiment of the present invention provides an apparatus to prevent actuation of a locking mechanism integrated in a door knob. The apparatus includes a door knob cover and a cap portion. The cap portion may be integrated into the door knob cover or may be a separate cap.

Commonly, the door knob is actuated by turning the door knob. The door knob cover is configured to engage the door knob during actuation of the door knob. In this example, the door knob cover would be rotated and engage the door knob thereby causing rotation of the door knob as well. Engagement of the door knob can occur by a surface of the door knob cover engaging the door knob due to the elasticity of the door knob cover, the geometry of the door knob, or tabs located on the inside of the door knob cover which may be pressed to engage the door knob.

The cap portion is configured to prevent the lock mechanism from actuating. The cap portion is preferably supported by the door knob cover and located over the locking mechanism. The cap is rigid, such that, any inadvertent pressure against the cap would be distributed away from the locking mechanism thereby preventing the actuation of the locking mechanism.

Further objects, features and advantages of this invention will become readily apparent to persons skilled in the art after a review of the following description, with reference to the drawings and claims that are appended to and form a part of this specification.

DETAILED DESCRIPTION

Figure 1:
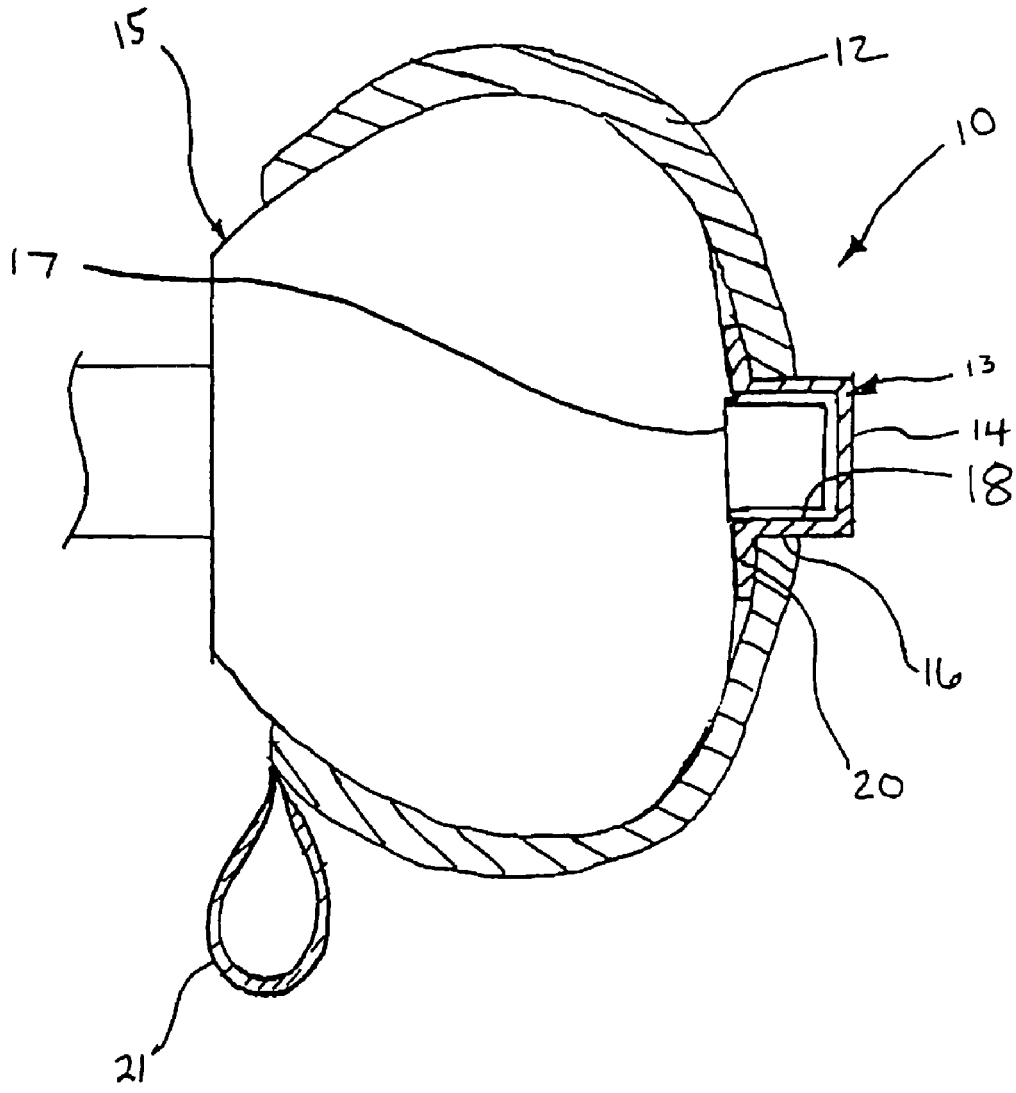
FIG. 1 is a sectional side view of an embodiment of the apparatus according to the present invention.
Figure 2:
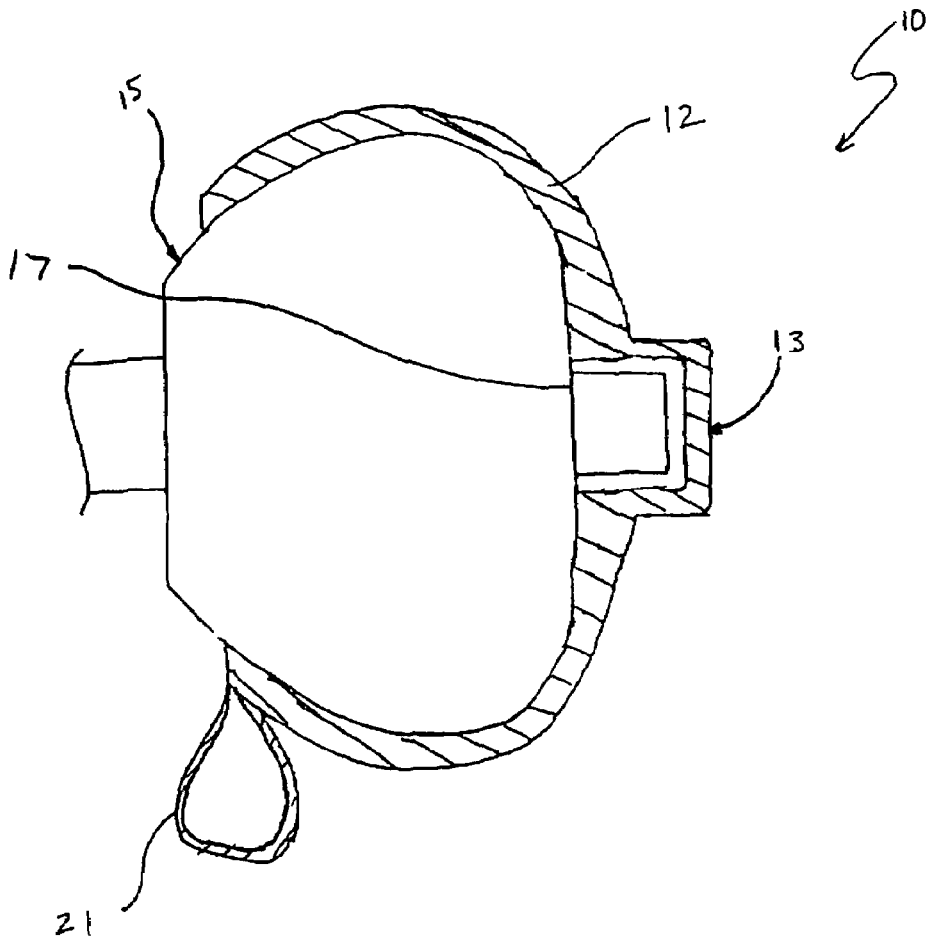
FIG. 2 is a sectional side view of another embodiment of the apparatus according to the present invention.

Referring to FIGS. 1 and 2, an apparatus embodying the principles of the present invention is illustrated therein and designated at 10. As its primary components, the apparatus 10 includes a door knob cover 12 and a cap portion 13. As shown in FIG. 1, the cap portion 13 may be a separate cap 14. However, as shown in FIG. 2, the cap portion 13 may be integrated into the door knob cover 12. The door knob cover 12 is configured to engage the door knob 15 allowing the door knob 15 to be actuated to open the door in a regular manner. In this embodiment, the door knob cover 12 is substantially circular for fitting over a circular door knob 15. However, as will be described later, the door knob cover 12 may be shaped and dimensioned to fit any style of door knob.

The door knob cover 12 may be made of an elastic material such as neoprene or rubber, alternatively, the door knob cover 12 may be made of rigid or semi-rigid or other suitable materials. The door knob cover 12 is shown to fit tightly to the door knob 15. For instance, the door knob cover 12 can be elastically stretched to fully cover and engage the door knob 15. Alternatively, the door knob cover 12 may be made in a rigid or semi-rigid shape having other features to engage the door knob 15 such as rubber pads or other support members configured to engage the door knob 15 during actuation to open the door.

In order to aid in removal of the door knob cover 15 from the door knob 12, a removal loop 21 may be attached to the door knob cover 15. Additionally, a decoration (not shown) may be placed on the surface of the door knob cover 15 and/or cap 14 in order to enhance the aesthetic qualities of the door knob cover 15.

The cap 14 is supported by the door knob cover 12 and located over the lock mechanism 17 included in the door knob 15. The cap 14 covers the lock mechanism 17, shown here as a button, to prevent inadvertent actuation of the lock mechanism 17. A cavity 18 is formed by portions of the cap 14 and fits around the locking mechanism 17. A lip 20 rigidly supports the cap 14 against the door knob 15 such that pressure against the cap 14 will be distributed away from the locking mechanism 17 thereby preventing actuation of the locking mechanism 17. The cap 14 may be made of a rigid plastic, metal, or other suitable material.

The cap 14 may be supported by an opening 16 in the door knob cover 12. Further, the cap 14 is located over the lock mechanism 17 and held snugly in place by the elastic nature of the door knob cover 12 pressing the cap 14 against the door knob 15. The lip 20 engages the portions of the door knob cover 12 defining the opening 16, thereby preventing the cap 14 from falling out of the opening 16.

Figure 3:
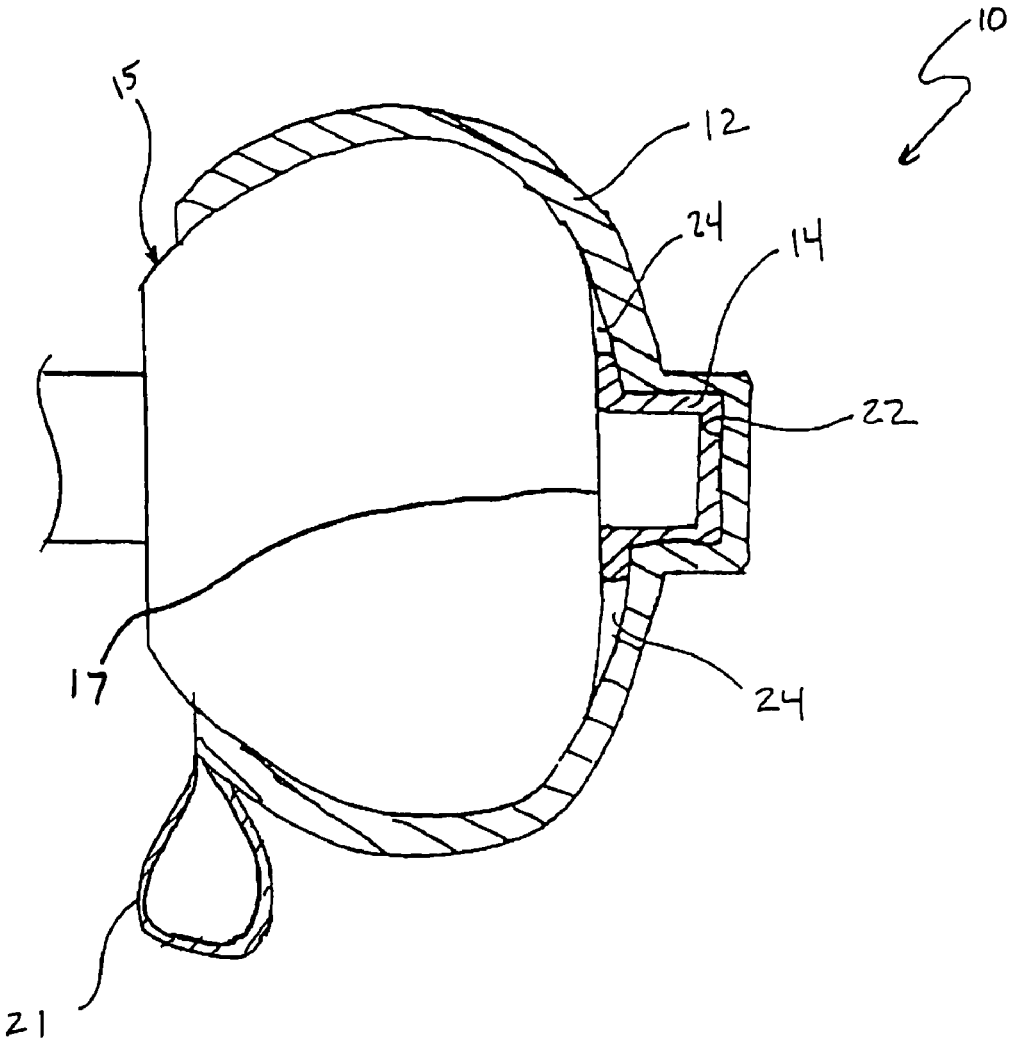
FIG. 3 is a sectional side view of another embodiment of the apparatus according to the present invention.

Now referring to FIG. 3, another embodiment of the present invention provides that the door knob cover 12 forms a cavity 22 to house and locate the cap 14 over the locking mechanism 17, thereby encapsulating the cap 14 between the door knob cover 12 and the door knob 15. Further, structural members 24 can be provided to radially support the cap 14.

Figure 4:
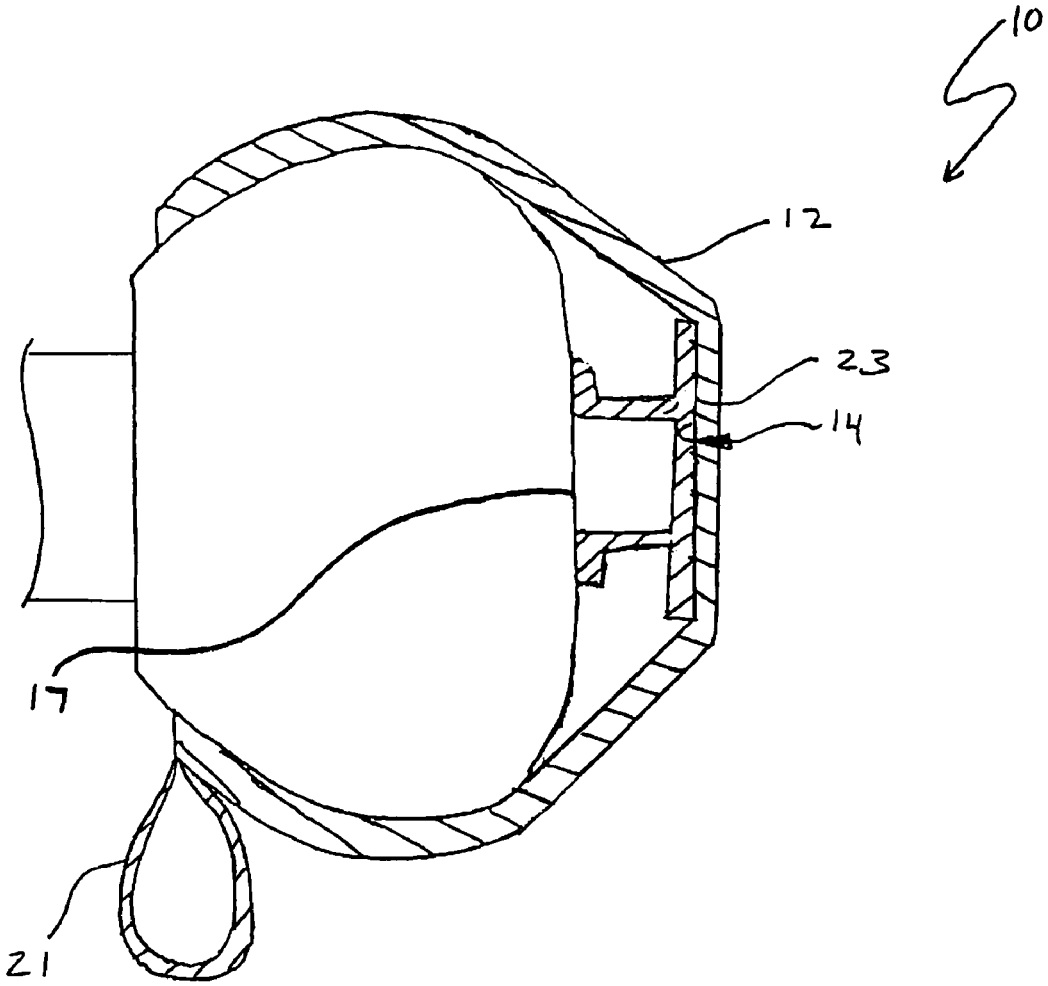
FIG. 4 is a sectional side view of another embodiment of the apparatus according to the present invention.

Now referring to FIG. 4, another embodiment of the present invention provides that the cap 14 includes a top 23 that extends in extends over the locking mechanism 17 and at least a portion of the door knob 15. The door knob cover encapsulates the cap 14 between the door knob cover 12 and the door knob 15.

Figure 5:
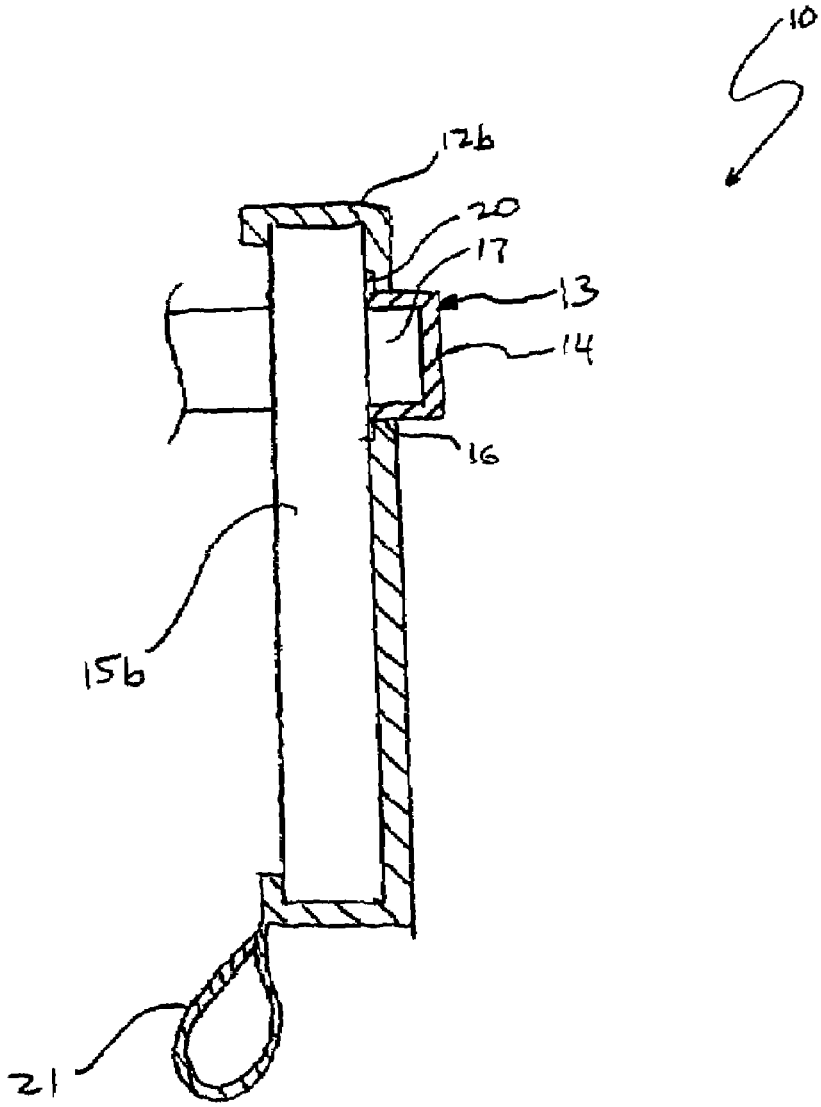
FIG. 5 is a sectional side view of another embodiment of the apparatus according to the present invention.

Now referring to FIG. 5, another embodiment of the present invention provides for a lever-style door knob 15*b* and a lever style-door knob cover 12*b*. The lever-style door knob cover 12*b* is substantially rectangular in order to fit around the lever-style door knob 15*b*. The principles of this embodiment are similar to the other embodiments. The door knob cover 12*b* is configured to engage the door knob 15*b* allowing the door knob 15*b* to be actuated to open the door in a regular manner. As such, the variation in the different embodiments shown in FIGS. 2, 3 and 4 are equally applicable in this embodiment.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

The invention claimed is:

1. An apparatus for a door knob having a locking mechanism integrated into the door knob and an actuator for actuating the locking mechanism, the actuator protruding from the surface of the door knob, the apparatus comprising:

a door knob cover frictionally coupled to portions of the door knob during actuation of the door knob, the door knob cover being made of a flexible material;

a rigid cap portion positioned between the door knob cover and the door knob, the rigid cap portion comprised of a top portion and a main member extending from the top portion toward the door knob, the main member defining a cavity to house the actuator protruding from the surface of the door knob for preventing the actuator from actuating; and a lip portion that extends perpendicularly from an end of the main member opposed to the top member to define a support surface in order to rigidly support the cap portion between the door knob cover and against the door knob, whereby the pressure against the rigid cap portion will be distributed away from the locking mechanism.

2. The apparatus of claim 1, wherein the door knob cover is substantially circular for fitting a circular-style door knob.

3. The apparatus of claim 1, wherein the door knob cover is substantially rectangular for fitting a lever-style door knob.

4. The apparatus of claim 1, wherein the door knob cover is made of at least one of neoprene and rubber.

5. The apparatus of claim 1, wherein the door knob cover further comprises a removal loop for aiding a user is removing the door knob cover from the door knob.

6. The apparatus of claim 1, wherein the rigid cap portion is a cap.

7. The apparatus of claim 6, wherein the cap is encapsulated between the door knob cover and the door knob.

8. The apparatus of claim 1, wherein the door knob cover defines an opening, the cap extending into the opening.

9. The apparatus of claim 1, wherein the lip portion is located between the door knob cover and the door knob, whereby the lip portion prevents the cap from exiting the opening.

10. The apparatus of claim 1, wherein the door knob cover further comprises a decoration.

11. The apparatus of claim 1, wherein the cap portion further comprises a top portion extending over the locking mechanism and at least a portion of the door knob.

12. The apparatus of claim 1, wherein the cavity defined by the cap portion only houses the actuator protruding from the surface of the door knob and does not house any portion of the door knob.

* * * * *